United States Patent [19]

Schmidt

[11] Patent Number: 4,493,201

[45] Date of Patent: Jan. 15, 1985

[54] METHOD OF MAKING A METAL BOTTLE FOR EXOTIC GASES UNDER PRESSURE

[75] Inventor: Donald J. Schmidt, DuBois, Pa.

[73] Assignee: Alco Industries, Inc., Valley Forge, Pa.

[21] Appl. No.: 459,780

[22] Filed: Jan. 21, 1983

[51] Int. Cl.[3] ..... B21D 22/00

[52] U.S. Cl. ..... 72/349; 29/422; 72/341; 72/342; 72/367

[58] Field of Search ..... 29/422; 72/347, 348, 72/349, 356, 341, 367

[56] References Cited

U.S. PATENT DOCUMENTS

| | | | |
|---|---|---|---|
| 1,059.212 | 4/1913 | Ross | 29/422 |
| 1,737,539 | 11/1929 | Petry | 72/367 |
| 1,966,713 | 7/1934 | Flint | 72/361 |
| 2,309,181 | 7/1943 | Franck | 29/422 X |
| 2,405,201 | 8/1946 | Franck | 29/422 |
| 2,659,128 | 11/1953 | Baldwin | 29/422 |
| 3,191,421 | 6/1965 | Coen | 72/348 |
| 3,651,559 | 3/1972 | Lawlor | 29/422 |
| 3,913,372 | 10/1974 | Baker | 72/348 |
| 4,173,883 | 11/1979 | Boik | 72/348 |
| 4,423,616 | 1/1984 | Pease | 72/348 |

*Primary Examiner*—Leon Gilden

*Attorney, Agent, or Firm*—Parmelee, Miller, Welsh & Kratz

[57] ABSTRACT

A strong, seamless one-piece metal bottle of substantially uniform wall thickness for containing and dispensing gas under pressure is produced from a flat metal piece by a series of deep-drawing operations to provide an elongated cylindrical shell having an open end mouth and a slight flange thereabout. A dimple is formed in its bottom end wall. The flange and an adjacent cylindrical open end mouth portion of the shell is then severed from the main body, and the wall thickness of the new open end mouth portion is tapered from the cylindrical side wall of the shell towards its mouth edge. Thereafter, the tapered open mouth end portion is turned or swaged inwardly into a somewhat blunt, rounded-in nose portion of a substantially uniform thickness that substantially corresponds in the thickness to the side and bottom walls of the formed metal bottle and that has an open end of reduced size suitable for mounting a nipple, ferrule or valve fitting therein.

18 Claims, 2 Drawing Figures

STEP 6 - LATHE TRIM
STEP 7 - TAPER TURN END
STEP 8A - PLACE SHELL IN DIE
STEP 8B - FORM NOSE
STEP 9A
PLACE FORMED SHELL IN DIE
STEP 9B - FINISH FORM NOSE
14'
10e
10f
18
25
28
33
35
34
19
31
10g
30
32
34'
33'
19'
10h

METHOD OF MAKING A METAL BOTTLE FOR EXOTIC GASES UNDER PRESSURE

BACKGROUND OF THE INVENTION

There has been a need for an inexpensive and practical procedure for providing seamless, one-piece gas dispensing metal bottles that may be used and reused for receiving and dispensing gas under pressure, such as oxygen, hydrogen, nitrogen, etc. Gas bottles are not only used in industry but also in medical facilities. The need is for a metal bottle of improved strength which is seamless, and is of substantially uniform thickness and strength throughout.

Heretofore, it has been customary to make bottles of two-piece, girth welded-together construction to reduce the expense involved from the standpoint of manufacture. However, such bottles do not have the strength required for reuse which is thus prohibited by industrial regulations. The expense involved in endeavoring to produce an elongated or deep seamless one-piece vessel or bottle as an end product has heretofore been prohibitive. It has not been practical to employ an impact-extruded or spun shell in endeavoring to provide an elongated or so-called deep bottle.

In endeavoring to find a solution to the problem, I found that certain factors had to be met, such as avoiding attempting to after-shape work-hardened areas, and avoiding shell wrinkling during the forming of a suitable nose. At the same time, a final product should be provided having a substantially uniform wall thickness throughout, and in an economical and practical manner.

I have been able to meet all the important factors involved, primarily by a two main step procedure in which a flat metal blank is progressively formed into an elongated cylindrical shell-like shape having an elongated cylindrical side wall of uniform diameter which at one end has an open mouth end portion and at its other end has a closed bottom end wall of substantially the same uniform thickness as the side wall. In a second main step, a portion of the side wall of the shape is reduced in thickness or tapered towards its open end and thereafter, the tapered area is turned-inwardly or swaged into a nose portion having an open mouth end of reduced size and whose wall thickness is substantially uniform therealong and with respect to the wall thickness of the remaining side wall and the bottom end wall. In an intermediate step, the shell-like shape as formed by the first main step may be further elongated, a dimple or depression simultaneously formed in its bottom end wall and a flange formed about its open end by employing a draw punch and die and a pilot punch. The worked flange portion of the shape is then severed before the tapering operation is effected. The dimpling provides the bottom end wall with curvilinear shape that tends to give it stability when a gas-filled bottle is placed in an upright position on a floor.

The necking-in, nose-forming operation is important in that no internal support is needed in forming the nose. This is an essential factor in enabling a one-piece construction. The shaping of the tapered nose area produces a substantially uniform thickness throughout that corresponds in thickness to the uniform thickness of the side and bottom end wall portions of the completed bottle. In this manner, a strong, seamless, lightweight bottle can be formed with a substantially uniform thickness and consistent wall strength. The dies used in swaging the nose first apply force in a circular, restricted engagement and progressively advance and widen such engagement from the side wall of the shape towards its open mouth in the direction of the reduced thickness of the wall taper, and in such a manner as to avoid wrinkling or crushing of the nose wall while working-thickening the tapered area towards the open mouth end. At the finish or end of the die movement, progressive full area contact has been made along the extent of the nose being formed.

The concept is unique, particularly from the standpoint of the second main steps thereof, with a nose being formed without the need for the employment of internal supporting or controlling structure for the wall of the shell-like shape being formed. In addition, the process is relatively inexpensive, such that the resultant product is cost-wise competitive with a two-part welded-together bottle that has the disadvantage of only being allowable for one filled usage before it has to be discarded. The process also avoids the expense and complications involved in attempting to form a bottle by spinning operations.

I have found that the weakest point in a shape is represented by the tangent at its closed end. By tapering the open end portion, I have been able to avoid wrinkling which tends to occur if the open mouth portion has a thickness greater than the cylindrical side wall. It is also important to start the forming of the nose as a circular line contact about the side wall and to advance it towards the edge of the open mouth end of the shell-like shape. A bottle made in accordance with the invention of deep drawing steel (such as SAE No. 30905, 30915) easily meets conventional requirements for withstanding gas pressures up to about 6100/sq. inch.

By way of example, I have started with a sheet steel having about 0.110 to 0.115 of an inch in thickness and finish with a bottle having a minimum wall thickness of about 0.095 of an inch. The total length of the finished bottle may be about ¼ of an inch shorter than the shell (see FIG. 8A) from which the finished nose portion is made. Although it is possible to provide a spun-formed shell for use in the initial bottle forming operations of my process, I find that a less expensive and better product is produced by a series of deep drawing preliminary forming operations.

Figure 2:
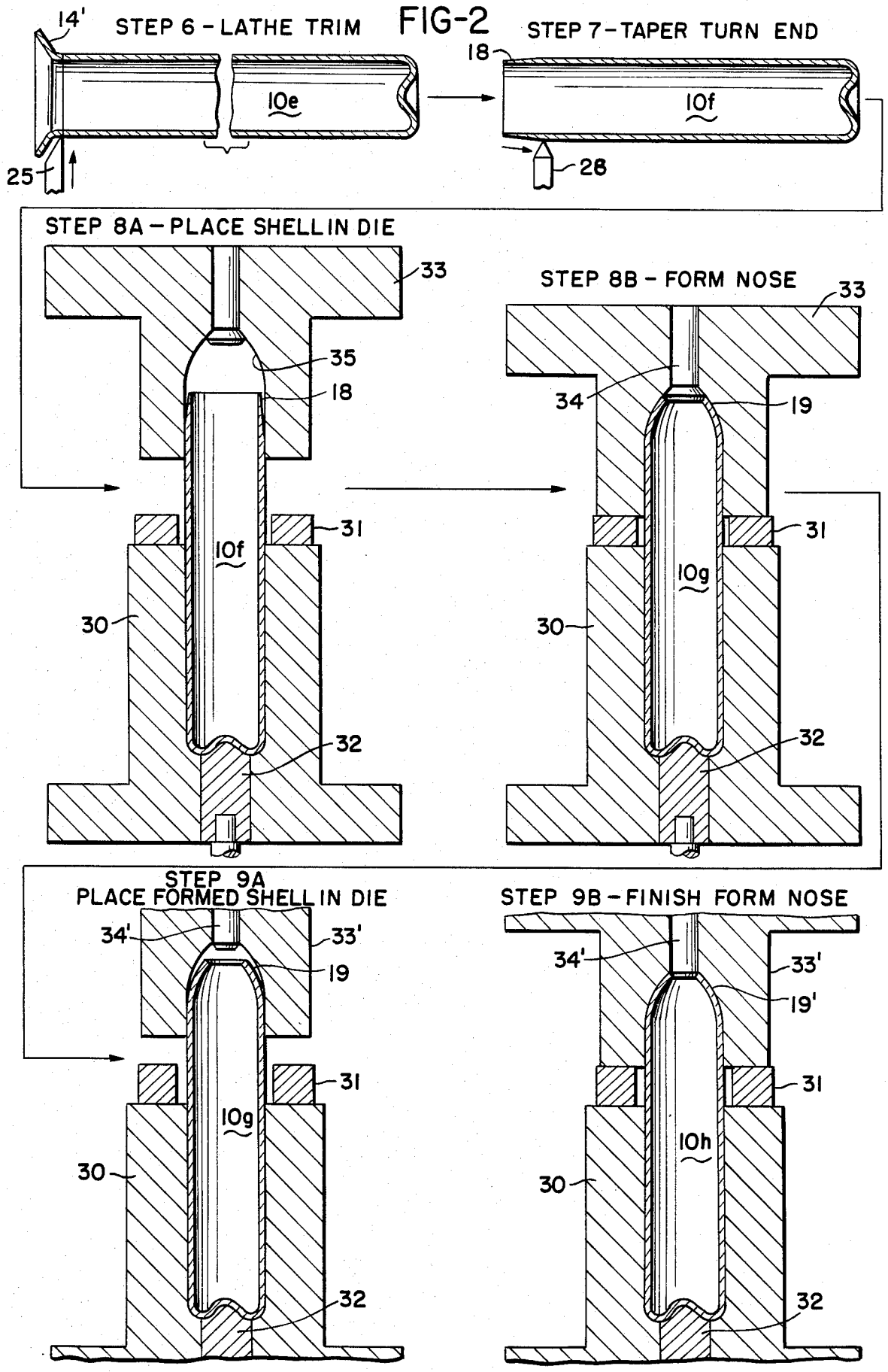

And,

FIG. 2 is a somewhat diagrammatic representation of sixth, seventh, eighth and ninth steps in completing the formation of a seamless metal bottle of the invention, particularly from the standpoint of the shaping and forming of its nose end.

DETAILED DESCRIPTION OF THE PREFERRED EMBODIMENT

Figure 1:
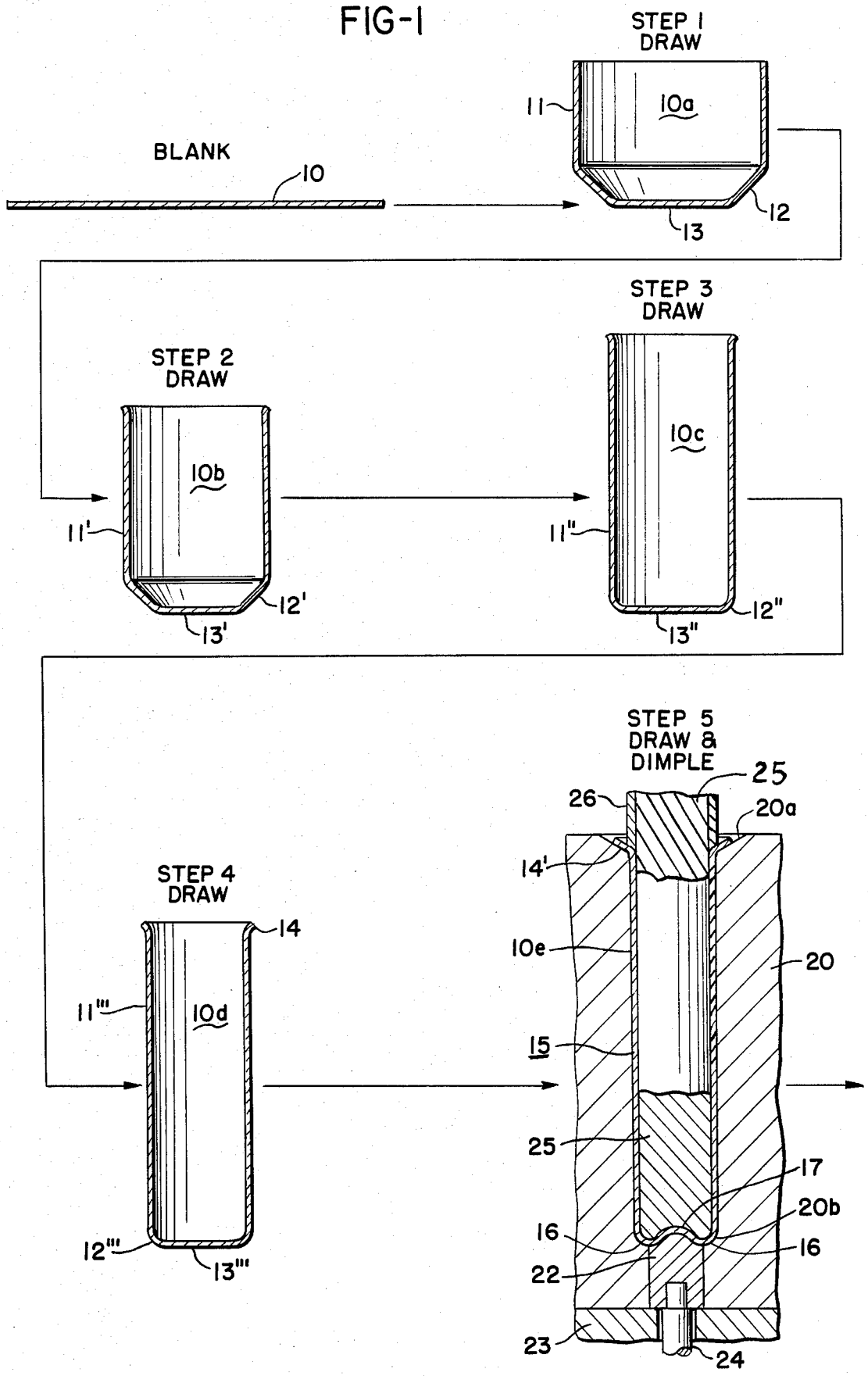
FIG. 1 is a somewhat diagrammatic representation of five deep drawing steps that are employed in forming a preliminary cylindrical shell-like shape provided with a position stabilizing dimple therein.

First referring to FIG. 1 of the drawings, a flat metal piece or blank 10 is shown deep-drawn by step 1 to form a preliminary shell-like shape 10*a* that has a cylindrical or uniform diameter, relatively short-length side wall 11, a closed flat bottom end wall 13, and an intermediate inclined connecting wall 12 of substantially planar section. The preliminary shell 10*a* is of hollow, somewhat squatty form. In a second deep-drawn step 2, the shell 10*a* is further elongated to provide a more cylindrical type of shape 10*b*, having a cylindrical side wall 11′ of greater length, an inclined connecting portion 12′ of slightly shortened length, and a closed, bottom end wall 13′ of shorter length. Next, in deep-drawing step 3, the shape 10*c* has been shown as elongated to provide a side wall 11″ of greater length, a connecting wall 12″ that is shortened and convexly rounded and which is, in effect, merged into the side wall 11″ and a bottom wall 13″ also of increased extent or length.

In step 4, the shape 10*c* is deep-drawn into a still further elongated shape 10*d* which has a slight, open-mouth end, outwardly extending flange or rim portion 14. Its side wall 11‴ is further elongated, its connecting portion 12‴ corresponds substantially to the portion 12″ of step 3, and its bottom end wall 13″ is of slightly shorter length or extent.

The shaped shell product 10*d* resulting from the above-mentioned four steps is then shown placed in a hollow die 20 having an upwardly outwardly sloped, flange-receiving end face 20*a*, and a rounded bottom end portion 20*b* which terminates in an open bottom end portion adapted to receive a dimple-forming die or punch 22. The dimpling die 22 is shown mounted on a knock-out rod 24, and is adapted to be slidably carried within a central opening in a bottom support 23. A hollow pilot punch 26 is shown adapted to engage the preliminary rim or flange 14 of the shell 10*d* of step 4 to engage it and press it against the die face 20*a* to thus enlarge it and hold the resultant flange 14′ and the hollow shape in position, while a punch 25 is moved through the hollow punch 26 and along the hollow shape into endwise engage-with the inside of its bottom end wall. The end of the punch 25 is complementary with and cooperates with the dimple forming die 22 to form a rounded, inwardly indented or concave dimple 17. As shown, the dimple 17 is connected by outwardly convex, rounded portions 16 to the side wall 15 of the shape 10*e* thus being formed. The hollow pilot punch 26 serves to center the shell 10*d* from the previous draw within the die 20 and controls the flow of material during the forming operation. It acts as a locator and applies force to prevent wrinkling by avoiding gather; it has an outer diameter that substantially conforms to the inner diameter of the shell 10*d*. Natural drawing and gathering of the material tends to work-harden flange portion area 14′ of the shape 10*e* thus formed. As indicated by comparison with the shape of 10*d*, this operation, through the agency of the punch 25 further elongates the side wall of the shape and narrows its body diameter while, at the same time, forming a stand-up position-stabilizing dimple 17 therein.

The steps illustrated particularly in FIG. 2 are considered crucial steps in the forming of an improved bottle of the invention. Step 6 shows the shape 10*e* which was previously formed in step 5 as having its work-hardened, outwardly projecting flange portion 14′ and adjacent wall portion severed by a cutting tool or element such as 25 to leave the shape 10*e* with an open-mouth end portion that no longer has a flange. In step 7, the shape 10*f* is shown shaved from its open end into an adjacent portion or banding area of its side wall by, for example, a lathe tool 28, to provide it with an open-end mouth portion 18 whose wall thickness is tapered towards its open mouth end from the cylindrical wall of uniform thickness.

In step 8A, the shape 10*f* is shown placed in a hollow bottom die 30 having a knock-out, end-closing element 32. A stop block 31 is placed on the face of the die 30 and between it an upper, moving die block 33. The upper die block 33 has a cone-shaped die wall cavity 35 that is adapted to be advanced from a preliminary circular line engagement with the full wall thickness of the side wall of the shape 10*f* to advance progressively along its tapered end portion 18 to form a preliminary nose end 19 (see step 8B) from the tapered portion 18 that is of slightly shortened length extent and whose wall thickness is substantially uniform and corresponds substantially in thickness to the thickness of the side wall and bottom end wall portions of the shape 10*g*. A mouth end shaping plunger 34 moves downwardly during step 8B to limit the amount of inward turning of nose portion 19 and provide it with a reduced size of open mouth end portion of uniform diameter.

In the next and final finishing steps, the shell or shape 10*g* is retained in the die assembly 30, 31 and 32, and an upper more converging moving die 33′ and its associated plunger are used. The dies 33′ plunger 34′ are advanced progressively in the same manner as dies 33 and 34 of steps 8A and 8B, from a preliminary, lowermost engaging relation or line into an advancing widening shaping engagement with the nose 19 of the shape 10*g*, so as to form final nose shape 19′ having a further somewhat flattened, final smaller size of open end mouth portion. The diameter of the open end of the nose 19′ is made to conform to a ferrule or other valving or connecting type of fitting to be used for introducing gas into and removing it from the strong, one-piece finished metal bottle 10*h*. It will be noted that the finished nose 19′ of the bottle is of a uniform thickness as formed from the tapered portion 18 of the step 8A, and is of substantially the same thickness as the uniform thickness of the cylindrical side and bottom end walls of the bottle 10*h* as formed.

Although ordinarily the process has been employed in making a bottle of ferrous steel metal, it can also be employed where the material is a stainless steel alloy or other suitable metal. The product produced is believed to be the first gas containing and dispensing one-piece metal bottle of a seamless wall construction whose bottom and side walls, as well as its nose end wall portion are all of substantially the same uniform thickness as well as strength throughout. The bottle 10*h*, as intimated before, can be produced so inexpensively that it is now competitive with a so-called girth-welded type of bottle which requires the use of two separately formed parts that are capable of being supported internally during their formation, but which in a final operation, require a welding together operation that makes the product unsuitable to the industry from the standpoint of gas refilling reusage thereof.

I claim:

1. A method of forming a strong seamless one-piece metal bottle of substantially uniform wall thickness throughout for containing and dispensing gas under pressure which comprises: first forming a metal shell having a closed bottom end wall and a forwardly extending cylindrical side wall of substantially uniform wall thickness therealong that terminates in an open-end portion that substantially corresponds in diameter to the inner diameter of the cylindrical side wall, tapering the wall thickness of an adjacent portion from the main body of the side wall by reducing its thickness towards its open-end portion, and therafter turning-in and rounding the adjacent portion into a nose portion defining an open-end mouth of reduced diameter for receiving a ferrule or the like therein and in such a manner as to provide the nose portion with a wall of substantially uniform thickness along its extent that substantially corresponds to the thickness of the main body of the cylindrical side wall.

2. A method as defined in claim 1 wherein the metal shell is formed by deep-drawing it from a flat metal blank in progressive elongating steps.

3. A method as defined in claim 2 wherein the nose portion is formed by oppositely endwise-applied forming pressure that is effected solely externally of the metal shell.

4. A method as defined in claim 1 wherein, a flange is formed about the open end portion, a dimple is formed in the closed bottom end wall, and the flange is severed to provide a new open-end portion before the tapering of the adjacent portion is effected.

5. A method as defined in claim 1 wherein, a flange is preliminarily formed about the open-end portion of the metal shell, an endwise position-retaining force is applied to the flange while an endwise-inward deforming force is applied to the bottom end wall to form a substantially central indentation therein, and the flange is then severed from the side wall to provide an open-end portion that is of substantially the same inner diameter as the side wall before the adjacent portion of the side wall is tapered.

6. A method as defined in claim 5 wherein the endwise-position-retaining force is applied by a locator sleeve having an outer diameter corresponding to the inner diameter of the metal shell and while the body of the shell is elongated and reduced in diameter.

7. A method as defined in claim 1 wherein the tapering of the adjacent portion of the side wall is effected by reducing its thickness towards the open-end from the outside of the metal shell.

8. A method as defined in claim 1 wherein the defined nose-forming operations on the metal shell are effected without applying internal supporting and shape-retaining force thereto.

9. A method as defined in claim 1 wherein the bottom end wall of the shell is preliminarily formed with a centrally concave dimple portion that is connected to opposite sides of the bottom end wall by rounded convex portions which terminate in the side wall of the bottom plunger that is endwise-projected against the bottom end wall of the shell.

10. A method as defined in claim 9 wherein the end flange is cut-off before the tapering operation is effected.

11. A method as defined in claim 1 wherein, the metal shell is formed by a progressive series of deep-drawing operations, starting with a flat sheet metal blank to preliminarily form a shell having a cylindrical side wall, a substantially planar closed bottom end wall, and a sloped converging connecting end wall of substantially planar section between the side wall and the bottom end wall; and the metal shell is completed before the tapering operation thereon by elongating the cylindrical side wall, shortening the bottom end wall, and rounding and merging the major length portion of the sloped connecting end wall into the cylindrical side wall.

12. A method of forming an elongated seamless cylindrical metal bottle for containing and dispersing gas under pressure which comprises: progressively deep-drawing a substantially flat metal blank into an elongated hollow shape having a closed-off bottom end wall and a cylindrical side wall extending therefrom and terminating at its opposite end in an open mouth portion, simultaneously forming an inside dimple in the bottom end wall and a projecting flange from the cylindrical side wall at the open mouth portion thereof by an application of endwise-opposed forces therebetween, cutting-off the flange from an adjacent cylindrical portion of the side wall to provide a new open mouth portion, shaving the new open mouth portion to taper it towards its open end and form a tapered thickness portion, and thereafter by a progression of steps forming the new open mouth tapered thickness portion into a converging nose portion of a substantially uniform thickness therealong that corresponds to the thickness of the main portion of the cylindrical side wall while forming an open-end of relatively smaller size suitable for receiving a ferrule therein.

13. A method as defined in claim 12 wherein the bottom end wall is during the dimpling operation formed into a curvilinear shape which has a central cross-extending outer concave portion and an adjacent outer convex portion that is connected to the cylindrical side wall.

14. A method of forming a seamless one-piece metal bottle for dispersing gas under pressure which comprises: taking a substantially flat metal blank and by a progression of deep-drawing steps forming it into a hollow cylindrical shape having a closed bottom end wall and a cylindrical side wall terminating in an outwardly flanged open mouth portion and with the bottom end and the side walls being maintained of substantially the same wall thickness, cutting-off the flanged open mouth portion and tapering an adjacent portion of the wall thickness of the cylindrical side wall by reducing its thickness towards the edge of the new open mouth portion, and thereafter necking the tapered new open mouth portion into an inwardly curved nose portion that terminates in an open-end nose of reduced diameter, all while retaining the remaining major portion of the cylindrical side wall and the bottom end wall in their previously formed shapes and substantially uniform thicknesses, and while forming the nose to a substantially uniform thickness along its extent that corresponds substantially to the uniform thickness of the end wall and the major portion of the side wall of the finished bottle.

15. A method of forming a strong reuseable seamless one-piece cylindrical metal bottle of substantially uniform wall thickness and strength throughout for containing and dispensing gas under pressure which comprises: in a first step, deep-drawing a flat metal blank of sheet metal into a hollow somewhat squatty first shape having a planar bottom end wall, having a cylindrical side wall surmounted by an open mouth portion, and having an inclined connecting wall of substantially planar section between the bottom end wall and the side wall, and with all of the walls of substantially the same thickness; in a second step, deep-drawing the first shape into an elongated second shape of lesser diameter having a cylindrical side wall of greater length, an inclined connecting wall of substantially the same length and shape, and a planar bottom end wall of shorter extent, and with all of the walls of substantially the same thickness; in a third step, deep-drawing the second shape into a further elongated cylindrical third shape in which the inclined connecting wall is shortened and formed into a rounded connecting corner between the side and bottom end walls, the bottom end wall is lengthened, and the side wall is further elongated, and with all of the walls of substantially the same thickness; in a fourth step, deep-drawing the third shape into a further elongated fourth shape having a greater length of cylindrical side wall, a shorter extent of bottom wall, and a slight curved outwardly diverging flange about its open mouth portion, and with all of the walls of substantially the same thickness; in a fifth step, deep-drawing the fourth shape into a fifth shape having a further elongated cylindrical side wall of reduced diameter, a larger more outwardly diverging flange, a bottom wall having a central inwardly projecting concave portion connected by a pair of side-positioned rounded convex portions, and with all the walls of subtantially the same thickness; in a sixth step, forming a sixth shape by cutting off the flange about the open mouth of the fifth shape; in a seventh step, shaving the side wall towards the cut-off open mouth thereof and providing it with a forwardly reduced tapered thickness portion towards its open mouth; finally, forming the seventh shape into a finished shape in which the tapered thickness portion is progressively necked inwardly from an initial line contact into a rounded nose of substantially uniform thickness with respect to the cylindrical side of the bottom end walls, and with the nose having an open mouth of reduced diameter to provide a gas filling and dispensing opening for the metal bottle.

16. A process as defined in claim 15 wherein hollow shaping die means is employed with a bottom wall supporting means in the final forming of the nose of the metal bottle.

17. A process as defined in claim 15 wherein, a punch is introduced through the open mouth of the metal shape while it is supported within a hollow die to form the shape progressively in a step by step manner during the first to fourth steps, in the fifth step, the punch engages the slight flange and forms the larger flange while a dimpling die engages the bottom end wall.

18. A process as defined in claim 15 wherein, the final forming is effected without inwardly restraining and supporting the shape and solely by force applied externally thereto to provide a finished metal bottle of substantially the same wall thickness and strength throughout and of a strong one-piece construction that may be used and reused for receiving and dispensing gases under pressure.

* * * * *